US005836092A

United States Patent [19]

Yarnell

[11] Patent Number: 5,836,092

[45] Date of Patent: Nov. 17, 1998

[54] SPORTS SHOE WITH RETRACTABLE SPIKES

[76] Inventor: James R. Yarnell, 335 Royal Burgess Dr., Campobello, S.C. 29322

[21] Appl. No.: 732,635

[22] Filed: Oct. 16, 1996

[51] Int. Cl.[6] ..... A43C 15/14

[52] U.S. Cl. ..... 36/61

[58] Field of Search ..... 36/61, 59 R

[56] References Cited

U.S. PATENT DOCUMENTS

| | | | |
|---|---|---|---|
| 1,361,078 | 12/1920 | Lynn | 36/61 |
| 1,662,111 | 3/1928 | Halstead | 36/61 |
| 3,716,931 | 2/1973 | Loudermilk . | |
| 3,793,751 | 2/1974 | Gordos . | |
| 4,375,729 | 3/1983 | Buchanen . | |
| 4,715,133 | 12/1987 | Hartjes et al. . | |
| 4,873,774 | 10/1989 | Lafever . | |
| 5,269,080 | 12/1993 | Davis . | |
| 5,289,647 | 3/1994 | Mercer . | |
| 5,299,369 | 4/1994 | Goldman . | |
| 5,337,494 | 8/1994 | Ricker . | |
| 5,497,565 | 3/1996 | Balgin | 36/61 |
| 5,526,589 | 6/1996 | Jordan | 36/61 X |

FOREIGN PATENT DOCUMENTS

| | | |
|---|---|---|
| 359026 | 9/1922 | Germany . |

*Primary Examiner*—Ted Kavanaugh
*Attorney, Agent, or Firm*—Chase & Yakimo

[57] ABSTRACT

A sports shoe with replaceable and retractable spikes. The shoe has a sole, comprising a plurality of spikes releasably and retractably mounted in the sole, a rack and pinion member mounted in the sole and in engagement with the spikes for extending and retracting the spikes from the sole and a release member for removing the spikes from the sole. The rack and pinion member includes a rack member with a rack gear which engages a pinion member at one end of each spike. The rack gear moves linearly and imparts rotational movement to the pinion members to extend and retract each spike from the sole. The rack member further includes an actuation tab extending exterior of the sole for easy movement of the rack. The release member includes a plurality of threaded members extending into the sole and a disengaging member at the rack member, which prevents extension and retraction of the spikes so that they are removable through the threaded members. The release member further includes a disk mounted on each spike exterior and in engagement with the sole to facilitate removal of each spike through a threaded member.

5 Claims, 7 Drawing Sheets

SPORTS SHOE WITH RETRACTABLE SPIKES

FIELD OF THE INVENTION

This invention relates to a sports shoe having replaceable, retractable spikes. More specifically, a rack and pinion system mounted within the shoe's sole retracts and extends the spikes. When the spikes wear out, they are also easily replaced with new spikes.

BACKGROUND OF THE INVENTION

Sports shoes, such as golf shoes, have a plurality of spikes which project outwardly from the bottom of the shoe's sole. The spikes are designed to dig into the ground and provide a solid footing. They prevent the golfer's foot from slipping laterally while swinging a golf club. A disadvantage of standard golf shoes is that the golfer must change shoes before entering restaurants, the club house and other facilities because the spikes would damage wooden floors and rip carpets. Also, it is not safe to operate an automobile while wearing spiked shoes. Of course other sports require similar shoes, such as softball and baseball, which pose these same problems.

These shoes are also generally very costly. To avoid the expense of purchasing a new pair of these shoes each time the spikes wear out, shoes with removable and replaceable spikes are preferred. Sports shoes with retractable spikes have been disclosed that incorporate pneumatic and mechanical devices to retract the spikes, but they do not allow easy replacement of worn out spikes.

SUMMARY OF THE INVENTION

Accordingly, a primary object of the subject invention is to provide a sports shoe with a sole having spikes mounted therein which retract and extend therefrom through the operation of a rack and pinion member mounted within the shoe's sole.

It is another object of the subject invention to provide a sports shoe having spikes threadably mounted in the shoe's sole for easy removal and replacement of the spikes.

Another object of the subject invention is to provide a sports shoe which, during the course of the selected sport, provides a solid footing to the wearer but does not harm the ground surface when the sport is not being played.

Yet another object of the subject invention is to provide a sports shoe with retractable spikes that are comfortable and easy to operate.

Still another object of the subject invention is to provide a sports shoe with retractable, replaceable spikes that are relatively inexpensive and easy to manufacture.

These objects are attained by providing a sports shoe having a sole, comprising a plurality of spikes releasably and retractably mounted in the sole, a rack and pinion member mounted in the sole and in engagement with the spikes for extending and retracting the spikes from the sole and a release member for removing the spikes from the sole. The rack and pinion member includes a rack member with a rack gear which engages a pinion member at one end of each spike. The rack gear moves linearly and imparts rotational movement to the pinion members to extend and retract each spike from the sole. The rack member further includes an actuation tab extending exterior of the sole for easy movement of the rack. The release member includes a plurality of threaded members extending into the sole and a disengaging member at the rack member, which prevents extension and retraction of the spikes so that they are removable through the threaded members. The release member further includes a disk mounted on each spike exterior and in engagement with the sole to facilitate removal of each spike through a threaded member.

Other objects and advantages of this invention will become apparent from the following description taken in connection with the accompanying drawings, wherein is set forth by way of illustration and example, an embodiment of this invention.

DETAILED DESCRIPTION

Figure 1:
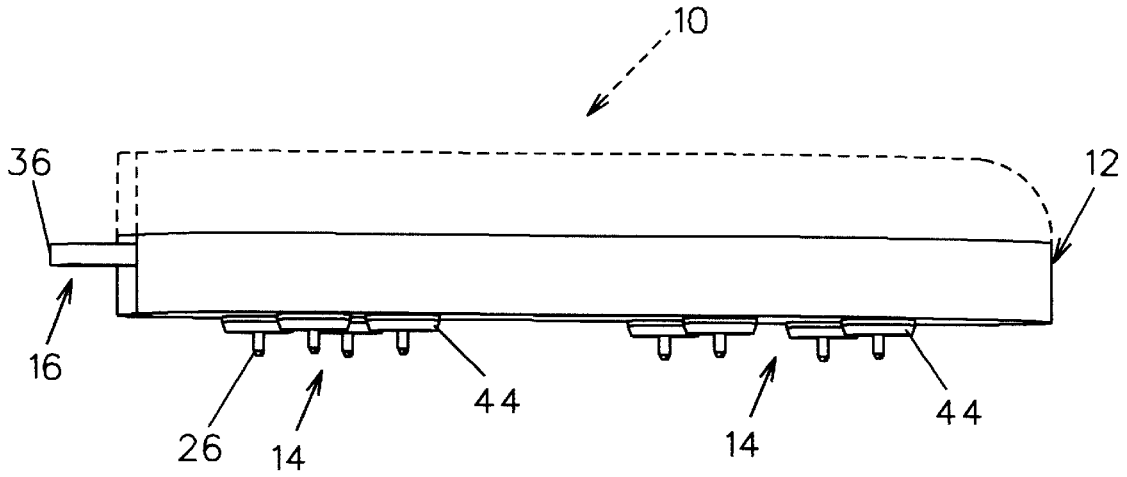
FIG. 1 is a side perspective of a portion of a sports shoe sole with spikes extending therefrom in accordance with the present invention.
Figure 2:
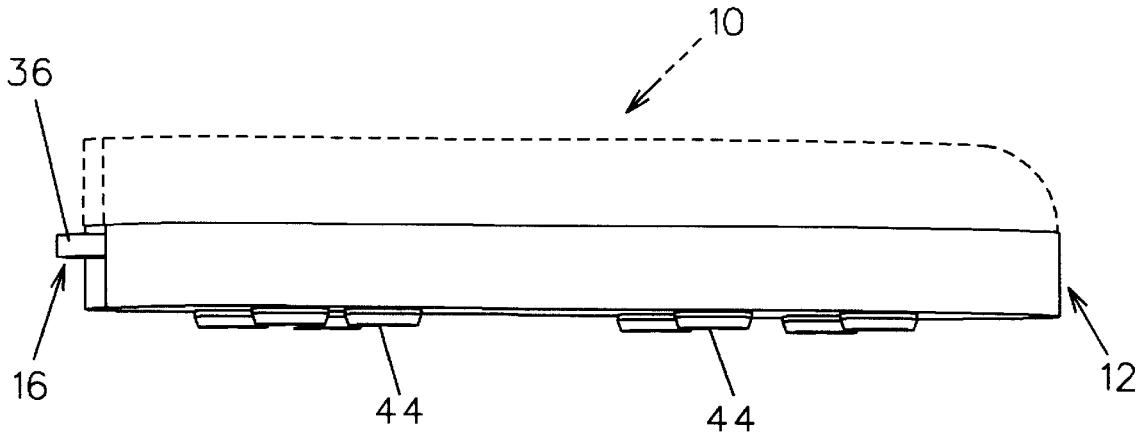
FIG. 2 is a side perspective as in FIG. 1, but with the spikes retracted.

Sports shoe 10, as in FIGS. 1–2 and 5–6, includes a sole 12 with retractable, replaceable spikes 14 mounted therein. Operation of rack and pinion member 16, within sole 12, causes spikes 14 to extend and retract relative to sole 12. Release member 18 allows spikes 14 to be easily replaced when they become worn out. As shown, sports shoe 10 is a golf shoe, but can be any type of shoe for use with any activity that requires spikes to enhance the wearer's footing.

Figure 7:
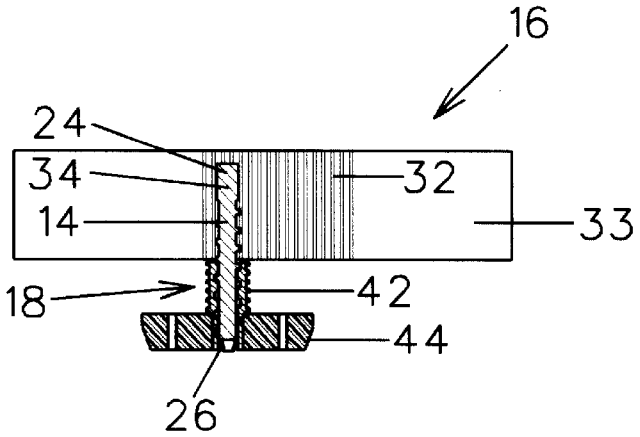
FIG. 7 is similar to FIG. 3 but shows the spike in cross-section.
Figure 8:
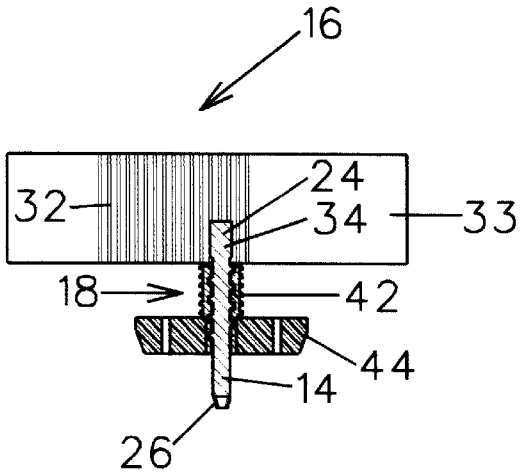
FIG. 8 is similar to FIG. 4 but shows the spike in cross-section.

Spikes 14 retract into (see FIGS. 2, 3 and 7) and extend from (see FIGS. 1, 4, 6 and 8) sole 12 when rack and pinion member 16 is operated by the shoe's wearer. A first end 24 of each spike 14 is securely but releasably and rotatably mounted within sole 12, and a second end 26 of each spike 14 preferably extends approximately a ¼" from sole 12 to penetrate the ground surface and retracts until substantially flush with sole 12. Second end 26 of each spike is preferably tapered to allow easy penetration of the ground surface. At least a portion of each spike's exterior surface is threaded. See FIGS. 7 and 8. The threads on spikes 14 should not be restricted to a course or fine Unified Thread series, but can be any kind of linear guide that can move a spike ¼" in distance. Spikes 14 typically present a solid cylinder formed of rigid material such as metal or plastic.

Figure 5:
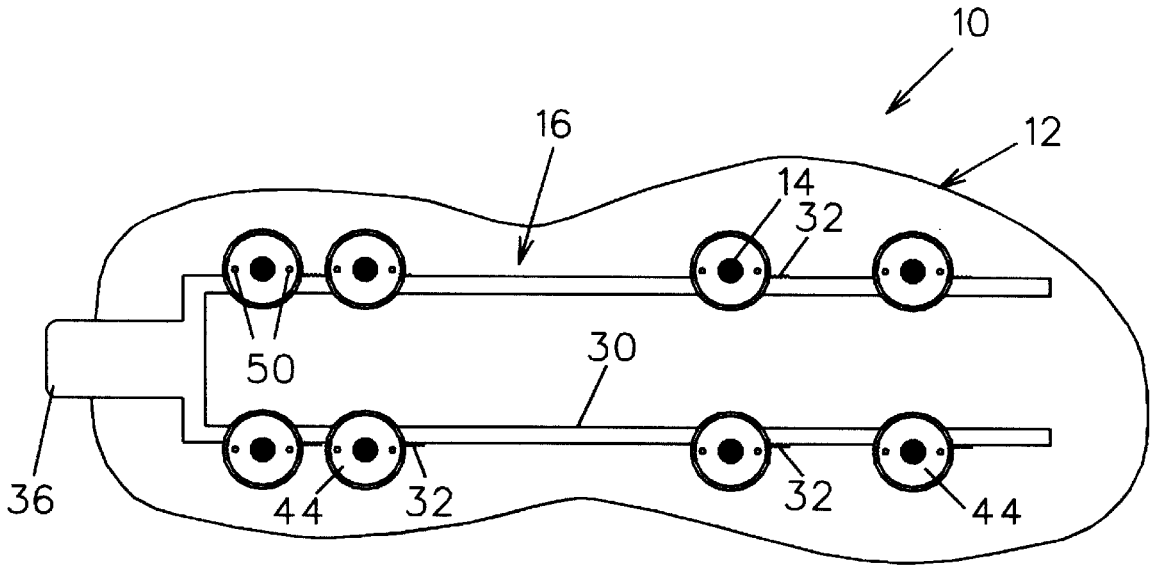
FIG. 5 is a bottom view of a sports shoe in accordance with the present invention with a portion of the sole removed for clarity.

Rack and pinion member 16 includes rack member 30, rack spur gear 32, pinion 34 and actuation member or tab 36. Rack member 30 is mounted horizontally or longitudinally within a channel formed in the interior of sole 12, as best seen in FIG. 5. Rack member 30 is preferably formed of a lightweight, flexible material to maintain the comfort of shoe 10. A plurality of rack spur gears 32 are on rack member 30. Each rack gear 32 aligns with a corresponding pinion or spur gear 34.

Figure 6:
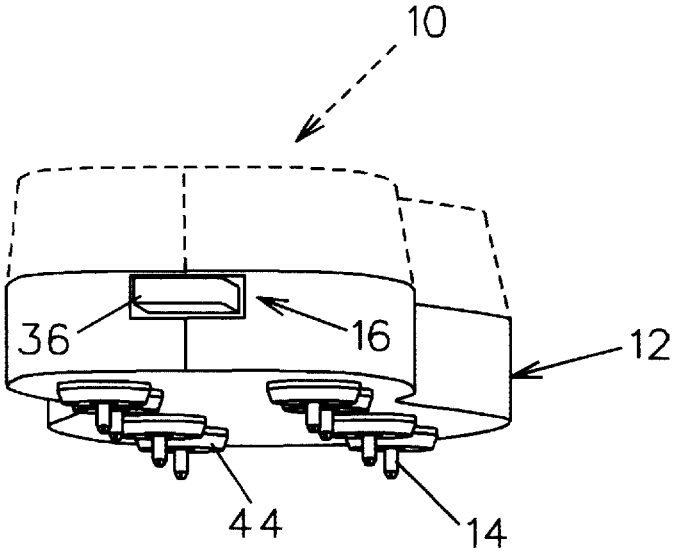
FIG. 6 is a rear perspective view of a shoe's sole in accordance with the present invention with the spikes extended therefrom.

A pinion 34 is formed at the first end 24 of each spike 14. See FIGS. 3–5 and 7–9. Each pinion 34 engages a corresponding rack gear 32 (as in FIG. 5) to extend and retract spikes 14 upon actuation of rack and pinion member 16. Pinions 34 need to be of sufficient length to allow the corresponding spike 14 to rotate in and out (between the extended and retracted positions) and should have a slightly smaller diameter than that of the threads on each spike 14. Actuation member or tab 36 is formed integrally and unitarily with rack member 30 and extends outwardly therefrom, exterior of sole 12 at its heel portion, as best seen in FIGS. 5 and 6.

Figure 3:
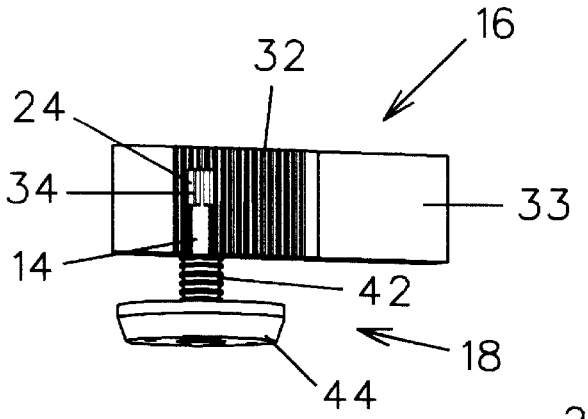
FIG. 3 is a partial side view of the rack and pinion system, with the spike retracted and with the sole removed for clarity.
Figure 4:
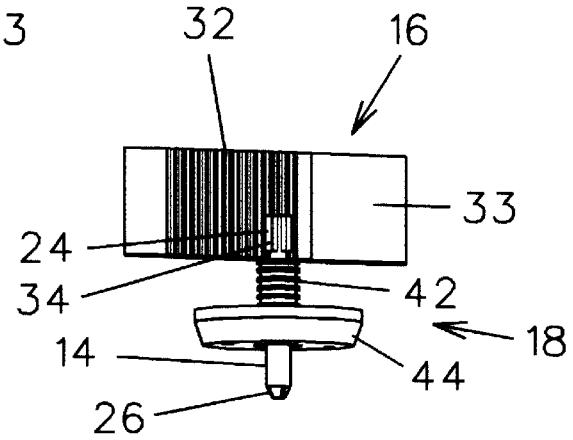
FIG. 4 is a side view of the rack and pinion system, with the spike extended and with the sole removed therefrom for clarity.
Figure 9:
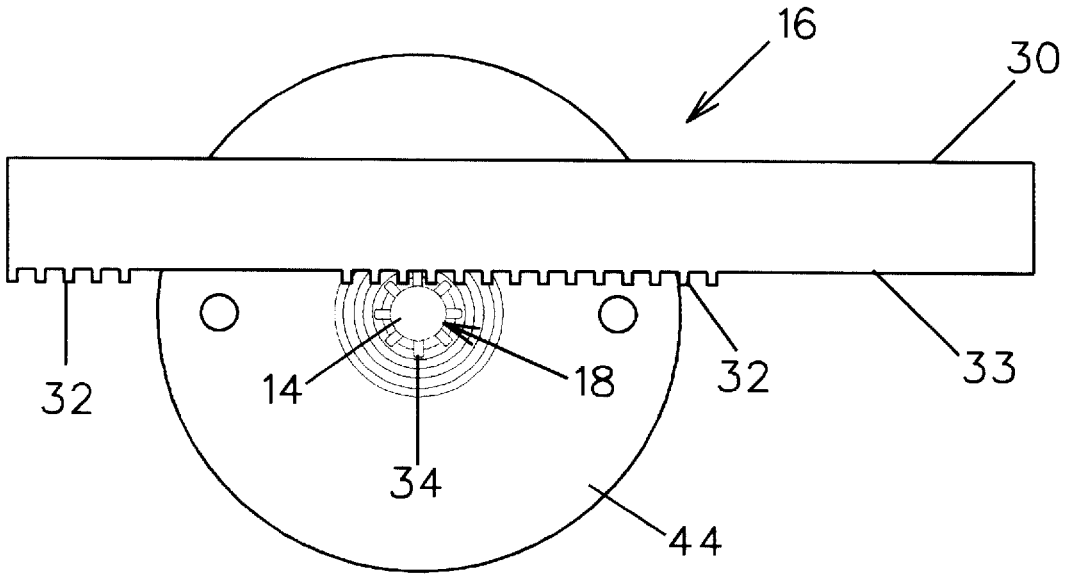
FIG. 9 is a top view of the rack and pinion system in accordance with the present invention, with the sole removed therefrom for clarity.

Release member 18 includes disengaging member mounting stems 42 and disks 44. Disengaging member may be formed on rack member 30 as an ungeared portion 33, as seen in FIGS. 3, 4 and 9, which prevents further extension and retraction of spikes 14. At this position spike 14 may be removed from sole 12. Alternatively, notches or grooves may be formed in the tab's 36 periphery to limit travel by rack member 30 to a certain length and prevent further extension and retraction of each spike 14.

Each mounting stem 42 presents a rigid, hollow cylinder with an internally threaded passageway therethrough as well as a threaded exterior surface. Each mounting stem 42 is threadably received in a threaded aperture formed in sole 12. Stems 42 are preferably approximately ¼" in length and after insertion into a threaded aperture in sole 12, an end of stem 42 is preferably flush with the exterior outer surface of sole 12. A spike 14 is threadably mounted in its corresponding stem's passageway, with first end 24 of spike 14 extending outwardly therefrom to present pinion 34 within sole 12. Each spike 14 is formed to have a very close tolerance within its corresponding mounting stem 42 to prevent any material from getting into the passageway of each stem 42.

Each disk 44 is preferably formed integrally with a spike 14 and engages the outer, exterior surface of sole 12 immediately adjacent a corresponding mounting stem 42. Disks 44 are usually convex in shape, approximately an ⅛" thick and formed of a lightweight, rigid material. Each disk 44 also has two apertures 50 extending therethrough, spaced 180° apart near the disk's perimeter. Preferably, apertures 50, as seen in FIG. 5, are spaced and sized to allow a divot repair tool to fit therein for easy rotation thereof for replacement of each spike 14.

In operation, the shoe's wearer pulls actuation tab 36 away from sole 12, which causes linear movement of rack member 30 and each rack gear 32. This linear movement translates into rotational movement on each rack gear's corresponding pinion 34 and spike 14. Each spike 14 is allowed to rotate through its corresponding mounting stem 42 into its extended position. Spikes 14 are then retracted by simply pushing actuation tab 36 toward sole 12 which causes pinions 34 and spikes 14 to rotate in the opposite direction. See FIGS. 1–4. The total travel of each spike 14 from fully retracted to fully extended does not need to be any more than ¼", and a portion of sole 12 can be hollowed out to accommodate that movement for each spike 14.

Worn out spikes 14 are easily replaced. As each pinion 34 moves across its corresponding rack gear 32, it ultimately reaches an ungeared portion 33 on rack member 30 which prevents any further rotation of each pinion 34 and thus, the corresponding spike 14. Alternatively, notches or grooves (not shown) formed in the periphery of actuation tab 36 limit the movement of tab 36 and thus, rack member. This also effectively disengages spikes 14 from rack gear 32. In either case, spikes 14 are easily removed from within sole 12 and replaced by inserting a divot repair tool into apertures 50 of each disk 44 and turning. Because pinions 34, at the first end 24 of each spike 14, have a slightly smaller diameter than that of the threads on each spike 14, spikes 14 are easily screwed into and out of the corresponding mounting stem 42, depending upon the direction that disks 44 are rotated.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A sports shoe having a sole, comprising:

a plurality of spikes mounted in apertures in said sole for movement between a first position extending beyond said sole apertures and a second position retracted within said sole apertures;

a pinion mounted at an end of each of said spikes for engagement with a rack;

said rack slidably mounted in said sole in first and second opposed directions, said rack having a plurality of rack gears thereon for engagement with a corresponding pinion, a movement of said rack in said first direction rotating each said pinion and spike attached thereto in a first direction for said extension of each said spike beyond said sole to said first position, movement of said rack in said second direction rotating each said pinion and spike attached thereto in a second direction for retraction of each said spike within said sole to said second position;

release means for disengaging said pinions from said rack, whereby to allow for removal of said spikes from said sole apertures;

said release means including a plurality of threaded members extending into said sole apertures, each said spike being releasably engageable with a corresponding threaded member.

2. A shoe as claimed in claim 1, wherein said release means includes a planar portion on said rack for interface with said pinions, said planar portion disengaging said pinions from said rack gear for removal of said spikes from said corresponding apertures.

3. A shoe as claimed in claim 1, wherein said release means includes a disk about a free end of each said spike opposite said pinion and engageable with an exterior of said sole, rotation of said disk facilitating removal of each said spike from said corresponding sole aperture.

4. A sports shoe having a sole, comprising:

a plurality of spikes rotatably mounted in apertures in said sole;

a rack assembly including a plurality of rack gears in said sole for engaging a pinion member at one end of each spike, a movement of said rack assembly in back and forth directions rotating each pinion member in opposed directions to either extend or retract said spike from or into each of said sole apertures;

a tab attached to said rack assembly and extending exterior of said sole for movement of said rack in said back and forth directions;

disengaging means on said rack assembly for disengaging said pinion member of each of said spikes from said respective rack gear;

a plurality of threaded sockets extending into said sole apertures for threadably receiving a respective spike therein, said spike releasably removable from said socket upon said disengagement from said rack assembly by said disengaging means.

5. A shoe as claimed in claim 4 further comprising a disk about each said spike exterior of said sole, a rotation of said disk rotating each said spike to facilitate removal from each socket.

* * * * *